United States Patent [19]

Fraser et al.

[11] 4,262,937

[45] Apr. 21, 1981

[54] CARBONLESS IMAGING SYSTEM

[75] Inventors: William J. Fraser, Forest Lake; Norman P. Sweeny, North Oaks, both of Minn.

[73] Assignee: Minnesota Mining and Manufacturing Company, St. Paul, Minn.

[21] Appl. No.: 41,557

[22] Filed: May 23, 1979

[51] Int. Cl.[3] ..... B41M 5/16; B41M 5/22

[52] U.S. Cl. ..... 282/27.5; 101/DIG. 1; 106/14.5; 106/21; 427/150; 427/152; 428/211; 428/307; 428/537; 428/914

[58] Field of Search ..... 106/21, 14.5, 22, 27, 106/32; 260/559 A, 559 H; 101/DIG. 1; 282/27.5; 427/150, 151, 152; 428/307, 411, 537, 913, 914, 21

[56] References Cited

U.S. PATENT DOCUMENTS

| | | | |
|---|---|---|---|
| 3,244,550 | 4/1966 | Farnham et al. | 117/36.2 |
| 3,411,976 | 11/1968 | Heliker et al. | 161/5 |
| 3,481,759 | 12/1969 | Ostlie | 282/27.5 |
| 3,547,646 | 12/1970 | Hori et al. | 260/559 H |
| 3,809,668 | 5/1974 | Yarian | 260/30.6 R |
| 3,852,094 | 12/1974 | Yarian | 282/27.5 |
| 4,111,462 | 9/1978 | Lange et al. | 282/27.5 |

OTHER PUBLICATIONS

Sacconi, J.A.C.S., 75, 5434 (11-5-53).
The Merck Index, 728 (8th edition 1968).

*Primary Examiner*—Bruce H. Hess
*Attorney, Agent, or Firm*—Cruzan Alexander; Donald M. Sell; Jennie L. Giese

[57] ABSTRACT

Carbonless imaging system containing transfer control agent to prevent undesirable back-transfer of image to transfer medium. The transfer control agent is selected from oxalic acid, phosphoric acid, or mixtures thereof. Transfer media and business forms are also described.

27 Claims, No Drawings

CARBONLESS IMAGING SYSTEM

This invention relates to carbonless imaging systems comprising organic color-forming compositions capable of combining with metal salts to form colored complexes. More specifically, the present invention relates to organic color-forming compositions containing a transfer control agent which prevents undesirable back-transfer of the colored complex. The transfer control agents used in the invention are oxalic acid, phosphoric acid and mixtures thereof.

Carbonless systems comprising transfer and record sheets have been widely used in multi ply business forms and other record forms for a number of years. In the carbonless system, one surface of a carrier may contain one of a pair of color-forming compounds, e.g. DTO and/or its derivatives, while a second carrier may have on one surface a second, coreactant, color-forming compound, e.g. a transition metal salt such as a nickel salt. When the first compound is brought into contact with the second compound, a complex is formed which has a color distinct from the color, if any, of the individual color-forming compounds. By causing contact in selected, localized areas, images can be formed. Generally, one of the compounds, such as the DTO compound, is carried in a liquid cosolvent vehicle (a vehicle which is a solvent for all of the compounds involved in the color-forming reaction) to facilitate transfer to a selected location and subsequent complexing of the color-forming compounds. One of the color-forming compositions can be encapsulated, if desired, to be released in selected areas on rupture of certain of the capsules by the application of localized pressure.

In the trade, the carbonless transfer and record sheets are often designated by the terms CF, CB and CFB which stand respectively for coated front, coated back and coated front and back sheets. Typically, the CB sheet will have an encapsulated color-forming composition comprising one or more color-forming compounds in a cosolvent vehicle. This CB sheel will overlie a CF sheet having a coating of a second color-forming compound on its surface. When the capsules are ruptured by pressure, such as by a pen, typewriter, or the like, the color-forming composition flows onto the CF sheet and complexes with the second color-forming compound and forms a localized colored area corresponding to the impacted area. As can be appreciated, CFB sheets can be interposed between the CB and CF sheets described above. Further, the top sheet can also be a CFB sheet so that markings on its obverse surface can be made using carbonless chemistry transferred from a separate carrier such as a transfer ribbon. Moreover, the surface of each sheet may be fully or partially covered by the color-forming compositions.

In one known application of this technology a first color-forming composition, e.g. containing DTO, is transferred from a ribbon by impact printing techniques to a CF record sheet which carries on selected portions of its surface a second color-forming composition, e.g. containing a transition metal salt. Visible images will appear on the portions of the CF record sheet where the first color-forming composition contacts the second color-forming composition whereas no visible images will appear in areas which do not contain the second composition even though the first composition has been transferred by impact thereto, e.g. for the purpose of causing image formation in an underlying sheet.

The technique described above have been used successfully to eliminate the need for a carbon transfer sheet in the preparation of previously known prestuffed envelope assemblies such as are shown in U.S. Pat. Nos. 3,104,799; 3,777,971; 3,830,141 and 3,988,971. By employing carbonless chemistry and techniques, information can be selectively printed on the front of the prestuffed envelope assembly while simultaneously selectively transferring additional information to one or more of the inserts within the envelope without this additional information appearing on the front of the envelope. This can be accomplished without the use of the conventional throw-away carbon transfer sheet by employing an envelope which has the front surface coated in selected areas with a color-forming composition and by using a transfer ribbon containing a color-forming coreactant composition. As the envelope passes through the printer, the information, such as the address, applied to the coated areas on the front of the envelope by the transfer ribbon will be made visible due to the colored complex formed by the coating and the coreactant material in the transfer ribbon. However, information "printed" on the uncoated areas will not appear on the front surface of the envelope due to the absence of the coreactive coating in these areas. By this method, both the information appearing on the outside of the envelope and the information to be transferred to the interior may be printed in a single pass through the printer without causing the information appearing on the interior of the envelope to appear on the outer sheet of the envelope.

While the use of the carbonless chemistry can be advantageous, one problem which is encountered with these carbonless systems is the problem of transfer of the colored metal complexes formed on a CF sheet back to the transfer medium, e.g. the transfer ribbon. This phenomenon is known as "back-transfer" and results in the transfer medium becoming contaminated with the colored imaging complex. When the carrier is a reusable carrier, such as a transfer ribbon where the same surface areas of the ribbon is repeatedly used before ribbon life has expired, the contaminated ribbon tends to produce undesirable colored marks when it contacts a substrate surface. Often the ribbon will provide markings where no mark is intended, for example, on the uncoated portions of a CF sheet.

The present invention overcomes the problem of back-transfer by the use of a transfer control agent in combination with the color-forming composition. The transfer control agents useful in the present invention are acids which are soluble or dispersible and stable in the cosolvent vehicle and which will combine with transition metal ions to form colorless films which will adhere to the substrate on which the transition metal color-forming compound is carried. While not wishing to be bound by any particular theory, it is believed that the transfer control agents form insoluble metal salts with the transition metals. These salts have no further reactivity with the color-forming compounds, such as DTO, and are believed to form a barrier film at the interface of the color-forming compositions preventing transfer of the colored complex formed on the CF sheet back to the transfer medium.

Acids which will perform the transfer control function in the present invention are oxalic acid, phosphoric acid and mixtures thereof. The effect of these acid transfer control agents in the present invention is particularly surprising in view of the observation that other, closely related, organic dicarboxylic acids, such as malonic and succinic acid are not effective to reduce back-transfer.

One aspect of the invention relates to color-forming compositions which are able to reduce or eliminate back-transfer. These compositions comprise one or more compounds capable of forming colored complexes with transition metal ions in the presence of a cosolvent vehicle, a cosolvent vehicle, and a transfer control agent selected from the group consisting of oxalic acid and phosphoric acid and mixtures thereof.

Another aspect of the invention relates to carriers including transfer media and carbonless systems containing the color-forming compositions described herein.

The carbonless systems of the present invention having reduced back-transfer comprise carriers having two distinct complementary compositions which when brought into contact in a cosolvent vehicle, will complex to form colored compositions having a color distinctly different from that of either of the compositions individually.

The first color-forming composition (which arbitrarily, and for convenience will sometimes hereinafter be referred to as the CB component) comprises one or more color-forming components which will complex with transition metal ions (CF component) to form colored complexes. These color-forming components are dispersed or dissolved in a cosolvent vehicle which additionally contains a transfer control agent comprising oxalic acid, phosphoric acid or mixtures thereof.

The color-forming CB components which will form complexes with transition metal salts are dithiooxamide (DTO), the N,N$^1$-diorgano substituted derivatives such as N,N$^1$-di-benzyldithiooxamide (DBDTO) and N,N$^1$-dioctanoyl oxyethyl dithiooxamide (DOEDTO), aromatic substituted hydrazones and mixtures thereof.

The aromatic substituted hydrazones which can be used in the practice of the present invention have the general formula

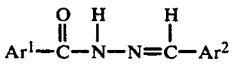

wherein Ar$^1$ and Ar$^2$ are independently selected aromatic substituents, Ar$^1$ being selected from the group consisting of phenyl, substituted phenyl, and substituted naphthyl, Ar$^2$ being selected from the group consisting of substituted phenyl and substituted naphthyl. Particularly preferred hydrazone compounds according to the general formula are 2-hydroxy-1-naphthaldehyde-p-t-butyl hydrazone and 2-hydroxy-1-naphthaldehyde-o-aminobenzoyl hydrazone. These hydrazone compounds are described and discussed in greater detail in commonly assigned copending applications Ser. No. 41,693, entitled "Imaging Composition" filed of even date herewith.

The DTO compounds complex with transition metal ions, such as nickel, to form blue-purple complexes while the hydrazones form yellow complexes. Mixtures of the DTO-based compounds and the hydrazone can be used to provide black complexed compositions.

The cosolvent vehicles useful in the present invention are organic liquids which are mutual solvents for both the color-forming components of the CB composition and the transition metal salts comprising the CF composition. The cosolvent serves as a liquid reaction-implementing medium for the CB and CF components when they are brought into contact.

As examples of solvents which fulfill the above criteria, mention may be made of cyclohexane, tributyl phosphate, diethyl phalate, toluene, xylene, 3-heptanone and trioctyl phosphate. These solvents can be used alone or in combination with each other.

The complementary color-forming composition (hereinafter sometimes referred to as the CF composition) comprises the transition metal salts of organic or inorganic acids. The preferred transition metal salts are the nickel salts, although copper, iron and other transition metals can be used to advantage. Inorganic acids which can be used to form the transition metal salts are acids which will provide salts with transition metals which dissociate to provide the transition metal for the color-forming reaction. Exemplary inorganic acids are nitric acid, sulfuric acid, hydrochloric acid and the like.

The organic acids which are useful in forming the transition metal salts of the present invention are the aliphatic and aromatic mono- and di- carboxylic acids, substituted aliphatic and aromatic monocarboxylic acids, and heterocyclic monocarboxylic acids. Monocarboxylic aliphatic acids containing about 6 to 10 carbon atoms are preferred color-forming transition metal salt. Other representative transition metal salts are the nickel, iron and copper salts of organic acids such as nickel rosinate, nickel calcium rosinate, nickel stearate, nickel 2-phenylbutyrate, nickel oleate, nickel benzoate and nickel hydrocinnamate as well as the corresponding copper and iron salts of the above compounds and mixtures of these compounds.

These CF compositions may be coated on substrates by conventional coating techniques known in the art or may be formulated into printing compositions and printed on all or a portion of a paper substrate. See, for example, U.S. Pat. No. 4,111,462 entitled "Latent, Sensitizing Ink".

The preferred color-forming CB compositions of the present invention comprise about 5 to about 30 percent by weight of the total composition of color-forming, metal-complexing compound, about 0.5 to 20 percent by weight, preferably about 1 to 10 percent by weight transfer control agent, the remainder being a cosolvent vehicle which may also include other additives such as colored pigments and the like, if desired.

The CB composition described above can be incorporated in a carrier and used to "develop" latent images comprising the CF compositions described above printed or coated on a substrate. In such a system, the CB chemistry can be dispensed from a flow pen or other source. Alternatively, the CB chemistry can be contained in a transfer medium such as a ribbon or pad and transferred to a substrate at least partially coated with CF chemistry in image-defining patterns. For example, the ribbon may be placed in contact with the CF coated sheet and impacted by a type font or other impact printing or writing means such as a stylus, pen or the like. The ribbon carrier can be formed of any material which can carry the CB composition and which is flexible and strong enough to withstand the impact forces of the printing device, and may be similar to those materials now used in commercial applications, including woven materials of nylon, rayon, cotton or various combinations of natural and synthetic fibers. If desired, and if the application permits, the ribbon may be a polyester film or other film, such as, for example, Mylar.

The CB chemistry may also be absorbed in a carrier such as a porous pad and transferred to a CF coated substrate by a transfer element such as a stamp or a portion of the human body such as a finger, palm, toe, foot, or the like. In this way printed images, fingerprints and the like may be obtained.

In yet another embodiment, the transfer control agents of the present invention can be utilized in combination with pressure releasable encapsulated color-forming compositions. Because the acid transfer-control agents are not readily encapsulatable by commonly used techniques such as described in U.S. Pat. No. 3,516,941, due to their water solubility, when encapsulated color-forming compositions are used, the transfer control agent must be applied as an overcoating of the acid in a cosolvent. For example, a conventional CB carrier, such as a paper sheet, having color-forming compound, such as DBDTO, etc., in a cosolvent encapsulated in pressure rupturable capsules and adhered to the surface, can be overcoated with a combination of the acid transfer control agent in cosolvent. The coated CB sheet will then exhibit significantly reduced back-transfer when used with a complementary CF sheet compared to a CB sheet not having the transfer control agent. The reduced back-transfer is achieved without loss of image speed and/or intensity similar to other embodiments of the invention described herein.

As noted hereinabove, when the CB compositions of the present invention are used in various transfer media and transferred to CF carrying substrates, back-transfer is significantly reduced or eliminated. The lifetime of a reusable transfer medium is thus increased. Additionally, when the transfer medium is used to transfer the CB color-forming composition to areas of the substrate not carrying the CF composition, the substrate will remain colorless and will not be soiled by imaging materials that have back-transferred to the transfer medium.

The practice of the invention can be further illustrated by reference to the following examples wherein all parts and percentages are by weight unless otherwise indicated.

EXAMPLE 1

A color-forming composition having improved back-transfer properties was prepared by admixing 4.8 gms. (0.0105 moles) of N,N$^1$-dioctanoyl oxyethyl dithiooxamide, 3.2 gms. (0.0105 moles) of N,N$^1$-dibenzyl dithiooxamide; 1.5 gms. (0.0166 moles) oxalic acid and 42 gms. (0.16 moles) of tributyl phosphate. The mixture was dissolved into solution with stirring at a temperature of 60° C. for about 30 minutes on a steam bath. Upon cooling, the solution was used to saturate a 10 cm. by 15 cm. woven nylon cloth carrier having a thickness of about 0.127 mm. thickness. When saturated the carrier contained about 0.13 gms. of color-forming composition.

A paper sheet was separately coated with a CF color-forming composition containing nickel-2-ethylhexoate.

The carrier was then impacted against the CF coating on the paper sheet with an impact printing device 30 to 40 times in the same area of the carrier and the CF sheet. Blue-purple images were formed on the CF sheet and no significant back-transfer to the carrier was observed.

A control prepared according to the above formulation, but without the oxalic acid transfer control agent exhibited significant back-transfer to the carrier when tested under the same conditions.

EXAMPLE 2

A composition similar to that of Example 1 was prepared using a higher level of oxalic acid according to the following formulation: 4.8 gms. (0.0105 moles) of N,N$^1$-dioctanoyloxyethyl dithiooxamide; 3.2 gms. (0.0105 moles) of N,N$^1$-dibenzyl dithiooxamide; 4.0 gms. (0.044 moles) of oxalic acid and 42 gms. (0.16 moles) of tributyl phosphate.

When tested as in Example 1, back-transfer was significantly reduced compared to the control.

EXAMPLE 3

A color-forming composition formulated to provide a black image was prepared according to the following formulation: 2.98 gms. (0.065 moles) of N,N$^1$-dioctanoyl oxyethyl dithiooxamide; 1.94 gms. (0.0065 moles) of N,N$^1$-dibenzyl-dithiooxamide; 0.65 gms. (0.0054 moles) of dithiooxamide; 0.65 gms. (0.0019 moles) of 2-OH-1-Naphthaldehyde-p-tertiary butyl benzoyl hydrazone; 2.44 gms. (0.027 moles) of oxalic acid and 55 gms. (0.21 moles) of tributyl phosphate.

When tested as in Example 1, black images were formed on the CF sheet. Back-transfer was significantly reduced when compared to a similarly formulated control without the oxalic acid transfer control agent.

EXAMPLE 4

A color-forming composition similar to Example 1 was prepared using phosphoric acid as the transfer control agent. The formulation was as follows: 4.8 gms. (0.0105 moles) of N,N$^1$-dioctanoyl oxyethyl dithiooxamide; 3.2 gms. (0.0105 moles) of N,N$^1$-dibenzyl dithiooxamide; 1.64 gms. of 85% (0.017 moles) of phosphoric acid and 42 gms. (0.16 moles) of tributyl phospate.

A second color-forming composition using phosphoric acid as the transfer control agent was formulated to provide a black image as follows: 2.98 gms. (0.0065 moles) of N,N$^1$ dioctanoyl oxyethyl dithiooxamide; 1.94 gms. (0.0065 moles) of N,N$^1$ dibenzyl dithiooxamide; 0.65 gms. (0.0054 moles) of dithiooxamide; 0.65 gms. (0.0019 moles) of 2-OH-1-Naphthaldehyde-p-tertiary butyl benzoyl hydrazone; 2.15 gms. (0.022 moles) of 85% phosphoric acid and 55 gms. (0.21 moles) of tributyl phosphate.

The above color-forming compositions provided blue-purple and black images respectively on the CF sheet when tested as in Example 1. Back-transfer was significantly reduced when compared to a control without the phosphoric acid back-transfer agent.

What is claimed is:

1. A color-forming composition comprising color-forming compound capable of forming colored complexes with transition metal salts, said color-former being selected from the group consisting of:

(1) dithiooxamide;

(2) N,N'-diorgano substituted derivatives of dithiooxamide;

(3) aromatic substituted hydrazones of the formula

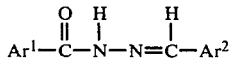

wherein Ar$^1$ and Ar$^2$ are independently selected aromatic substitutents, Ar$^1$ being selected from the group consisting of phenyl, substituted phenyl, and substituted naphthyl, and $Ar^2$ being selected from the group consisting of o-hydroxy substituted phenyl and o-hydroxy substituted naphthyl; and (4) mixtures of the above;

and a liquid cosolvent vehicle, wherein the improvement comprises a transfer control agent in an amount sufficient to reduce back-transfer, said transfer control agent being an acid capable of forming cosolvent-insoluble salts with transition metals and selected from the group consisting of oxalic acid, phosphoric acid, and mixtures thereof.

2. A color-forming composition according to claim 1 wherein said transfer control agent is oxalic acid.

3. A color-forming composition according to claim 1 wherein said transfer control agent is selected from the group consisting of phosphoric acid and a mixture of phosphoric acid and oxalic acid.

4. A color-forming composition according to claim 1 wherein said color-forming composition comprises, by weight of the total composition, 5 to 30% color-forming transition metal complexing compound, 0.5 to 20% transfer control agent and 50 to 94.5% liquid cosolvent vehicle.

5. A color-forming composition according to claim 4 wherein said transfer control agent is oxalic acid.

6. A color-forming composition according to claim 4 wherein said transfer control agent is selected from the group consisting of phosphoric acid and a mixture of phosphoric acid and oxalic acid.

7. An article for dispensing a color-forming composition comprising a carrier carrying therewith a color-forming composition comprising color-forming compound capable of forming colored complexes with transition metal salts, said color-former being selected from the group consisting of:

(1) dithiooxamide;

(2) N,N'-diorgano substituted derivatives of dithiooxamide;

(3) aromatic substituted hydrazones of the formula

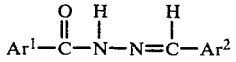

wherein $Ar^1$ and $Ar^2$ are independently selected aromatic substituents, $Ar^1$ being selected from the group consisting of phenyl, substituted phenyl, and substituted naphthyl, and $Ar^2$ being selected from the group consisting of o-hydroxy substituted phenyl and o-hydroxy substituted naphthyl; and (4) mixtures of the above; and a liquid cosolvent vehicle, wherein the improvement comprises a transfer control agent in an amount sufficient to reduce back-transfer, and transfer control agent being an acid capable of forming cosolvent-insoluble salts with transition metals and selected from the group consisting of oxalic acid, phosphoric acid, and mixtures thereof.

8. An article according to claim 7 wherein said transfer control agent is oxalic acid.

9. An article according to claim 7 wherein said transfer control agent is selected from the group consisting of phosphoric acid and a mixture of phosphoric acid and oxalic acid.

10. An article according to claim 7 wherein the carrier is an absorbent ribbon.

11. An article according to claim 10 wherein said transfer control agent is oxalic acid.

12. An article according to claim 10 wherein said transfer control agent is selected from the group consisting of phosphoric acid and a mixture of phosphoric acid and oxalic acid.

13. An article according to claim 7 wherein the carrier is a porous pad.

14. An article according to claim 13 wherein said transfer control agent is oxalic acid.

15. An article according to claim 13 wherein said transfer control agent is selected from the group consisting of phosphoric acid and a mixture of phosphoric acid and oxalic acid.

16. An article for dispensing a color-forming composition comprising (a) a carrier carrying therewith pressure rupturable microcapsules containing color-forming compound and cosolvent therefor, said color-former being selected from the group consisting of:

(1) dithiooxamide;

(2) N,N'-diorgano substituted derivatives of dithiooxamide;

(3) aromatic substituted hydrazones of the formula

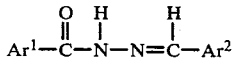

wherein $Ar^1$ and $Ar^2$ are independently selected aromatic substituents, $Ar^1$ being selected from the group consisting of phenyl, substituted phenyl, and substituted napthyl, and $Ar^2$ being selected from the group consisting of o-hydroxy substituted phenyl and o-hydroxy substituted naphthyl; and (4) mixtures of the above; and (b) overcoating the capsules a coating of a transfer control agent in cosolvent, said transfer control agent being an acid capable of forming cosolvent-insoluble salts with transition metals and selected from the group consisting of oxalic acid, phosphoric acid, and mixtures thereof.

17. An article according to claim 16 wherein said transfer control agent is oxalic acid.

18. An article according to claim 16 wherein said transfer control agent is selected from the group consisting of phosphoric acid and a mixture of phosphoric acid and oxalic acid.

19. A system for providing visible markings comprising (a) an article for dispensing a first color-forming composition comprising a carrier carrying therewith a color-forming composition comprising color-forming compound capable of forming colored complexes with transition metal salts, said color-former being selected from the group consisting of:

(1) dithiooxamide;

(2) N,N'-diorgano substituted derivatives of dithiooxamide;

(3) aromatic substituted hydrazones of the formula

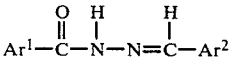

wherein $Ar^1$ and $Ar^2$ are independently selected aromatic substituents, $Ar^1$ being selected from the group consisting of phenyl, substituted phenyl, and substituted naphthyl, and $Ar^2$ being selected from the group consisting of o-hydroxy substituted phenyl and o-hydroxy substituted naphthyl; and (4) mixtures of the above; and a liquid cosolvent vehicle, wherein the improvement comprises a transfer control agent in an amount sufficient to reduce back-transfer, said transfer control agent being an acid capable of forming cosolvent-insoluble salts with transition metals and selected from the group consisting of oxalic acid, phosphoric acid, and mixtures thereof, (b) a paper substrate having on at least a portion of the obverse surface a second complementary, color-forming composition comprising a transition metal salt of a carboxylic acid, and (c) transfer means for transferring said first color-forming composition to selected areas of the obverse surface of said paper substrate.

20. A system according to claim 19 wherein said transfer control agent is oxalic acid.

21. A system according to claim 19 wherein said transfer control agent is selected from the group consisting of phosphoric acid and a mixture of phosphoric acid and oxalic acid.

22. A system according to claim 19 wherein said article is adjacent the obverse surface of said paper substrate and said transfer means is an impact printing device adopted to strike said article thereby causing localized transfer of said first color-forming composition to selected portions of the obverse surface of said paper substrate.

23. A system according to claim 22 wherein said transfer control agent is oxalic acid.

24. A system according to claim 22 wherein said transfer control agent is selected from the group consisting of phosphoric acid and a mixture of phosphoric acid and oxalic acid.

25. A system according to claim 19 wherein said transfer means is a portion of the human body.

26. A system according to claim 25 wherein said transfer control agent is oxalic acid.

27. A system according to claim 25 wherein said transfer control agent is selected from the group consisting of phosphoric acid and a mixture of phosphoric acid and oxalic acid.

* * * * *